United States Patent [19]

Csathy et al.

[11] 4,414,923

[45] Nov. 15, 1983

[54] HEAT RECOVERY BOILER FOR HIGH PRESSURE GAS

[75] Inventors: Denis G. Csathy; Robert J. Krowech, both of Minneapolis, Minn.

[73] Assignee: Deltak Corporation, Minneapolis, Minn.

[21] Appl. No.: 353,129

[22] Filed: Mar. 1, 1982

[51] Int. Cl.[3] ..... F22D 1/00

[52] U.S. Cl. ..... 122/7 R; 122/32; 122/33

[58] Field of Search ..... 122/367 R, 7 R, 32, 122/33, 123, DIG. 4, DIG. 3, 406 S

[56] References Cited

U.S. PATENT DOCUMENTS

| | | | |
|---|---|---|---|
| 1,558,573 | 10/1925 | Bancel | 122/DIG. 3 |
| 2,840,043 | 6/1958 | Durham | 122/7 D |
| 3,574,302 | 4/1971 | Csathy | 122/7 R |
| 3,662,718 | 5/1972 | Creek et al. | 122/32 |
| 3,827,484 | 8/1974 | Wolowodiuk | 122/32 |

OTHER PUBLICATIONS

"Evaluating Boiler Designs for Process-Heat Recovery", Denis Csathy, *Chemical Engineering,* May 22, 1967.

"Gas Turbine Exhaust Heat Recovery", Denis Csathy, Mar. 22, 1978.

"Heat Recovery from Dirty Gas", Denis Csathy, May 24, 1979.

"Latest Practice in Industrial Heat Recovery", Denis Csathy, Feb. 4, 1980.

"Industrial Heat Recovery-1982", Denis Csathy, Apr. 1982.

*Primary Examiner*—Henry C. Yuen

*Attorney, Agent, or Firm*—Quarles & Brady

[57] ABSTRACT

A boiler for generating steam by the recovery of heat from a hot gas stream including an enclosed pressure vessel, a baffle dividing the interior of the vessel into upper and lower compartments, one or more upper headers in the upper compartment, a bundle of water tubes supported from the upper headers and extending into the lower compartment, one or more lower headers supported by the lower ends of the water tubes, and a shroud structure in the lower compartment of the boiler extending about the perimeter of the bundle of water tubes.

4 Claims, 6 Drawing Figures

45
12
10
30
30
29
28
28
20
11
25
40
46
28
36
35
27
13
38

12
45
10
19
29
15
20
4
4
18
14
17
40
25
11
16
28
27
37
13
38

HEAT RECOVERY BOILER FOR HIGH PRESSURE GAS

TECHNICAL FIELD

This invention relates to boilers for producing steam by recovering heat from a stream of hot, high pressure gas.

BACKGROUND ART

Various chemical processes include a stream of gas at relatively high pressure that it also hot enough to make it desirable to recover heat from the gas stream and generate steam for further use in the process or for other uses within a plant. If the volume of the gas is high enough, however, it is impractical to use a fire tube boiler since its components, especially the outer shell, would have to be inordinately thick in order to withstand the mechanical stresses involved; this can also be a problem if high pressure steam is desired from the heat recovery boiler.

Moreover, a hot gas stream from which heat is to be recovered will often contain substantial amounts of solid particulates. This causes additional design problems for a heat recovery boiler because of the increased likelihood that the solids will accumulate on or about heat transfer components of a boiler and thereby substantially reduce its efficiency. This results in the need for periodic shutdown of the boiler for removal of the accumulated solids from the unit.

As one example, coal gassification processes often have a hot high pressure gas stream emanating from the gassification unit and have substantial requirements for steam. It is not unusual for coal gassification processes to have a gas stream at a pressure as high as 600 to 900 psig; also, the gas stream will contain quite substantial amounts of solids particulates. The gas stream is hot enough and steam requirements of the process are high enough to make it desirable to recover heat from the stream and use it to produce steam to meet the energy requirements of the process.

As another example, the so-called steam methane reforming process as employed in the production of methanol, ammonia, or hydrogen from natural gas can have gas streams with pressures as high as 300 to 500 psig from which it is desirable to recover heat for generation of process steam. Prior boiler designs for this purpose usually have been of either U-tube or bayonet tube designs. However, both of these types are prone to the accumulation of solids and difficult to clean when the accumulation reaches a level sufficient to significantly impair heat recovery.

The problems of prior heat recovery boiler designs that we are aware of for use in the foregoing processes were the impetus for the research and development work which resulted in our new boiler design described hereinafter. In addition, we have sought to provide a heat recovery boiler that can be effectively used to recover heat from gas streams of lower pressures, such as in the range of about 8 to 20 psig, as typically found in oil refining processes employing catalytic cracking.

DISCLOSURE OF THE INVENTION

Our new heat recovery boiler includes, in combination, an outer shell defining a vertical pressure vessel; a baffle extending across the vessel to divide it into upper and lower compartments; vertical water tubes inside the vessel and extending through the baffle with their upper ends connected to one or more headers in the upper compartment and their lower ends connected to one or more headers in the lower compartment; and shroud means adapted to direct gas entering the upper compartment longitudinally downwards through the lower compartment and along the water tubes.

BRIEF DESCRIPTION OF THE DRAWINGS

The present invention is described hereinafter in such full and concise detail as to enable those skilled in the art of boiler design and manufacture to practice the same, by reference to the following drawings in which.

BEST MODES FOR CARRYING OUT THE INVENTION

(A) Embodiment of FIGS. 1–4

A heat recovery boiler 10 that incorporates new features of construction in accordance with our present invention is illustrated in FIGS. 1–4.

The boiler 10 comprises a cylindrical shell 11 closed at its top end by a dished upper head 12 and closed at its bottom end by a dished lower head 13, to thereby form a closed pressure vessel or enclosure for the several elements of the boiler. The boiler may be made in any desired size, and we have designed one that is about eight feet in diameter and thirty-seven feet high.

Figure 3:
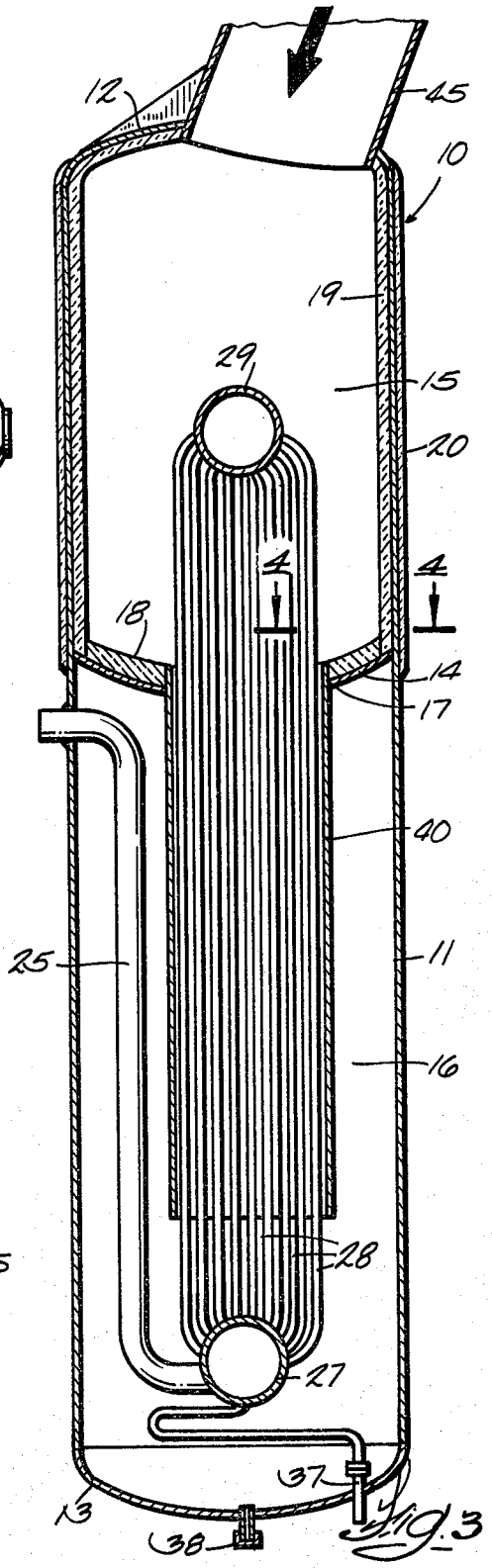
FIG. 3 is a longitudinal section view of the boiler of FIGS. 1 and 2 taken along a plane at an angle of 90° to FIG. 2.
Figure 4:
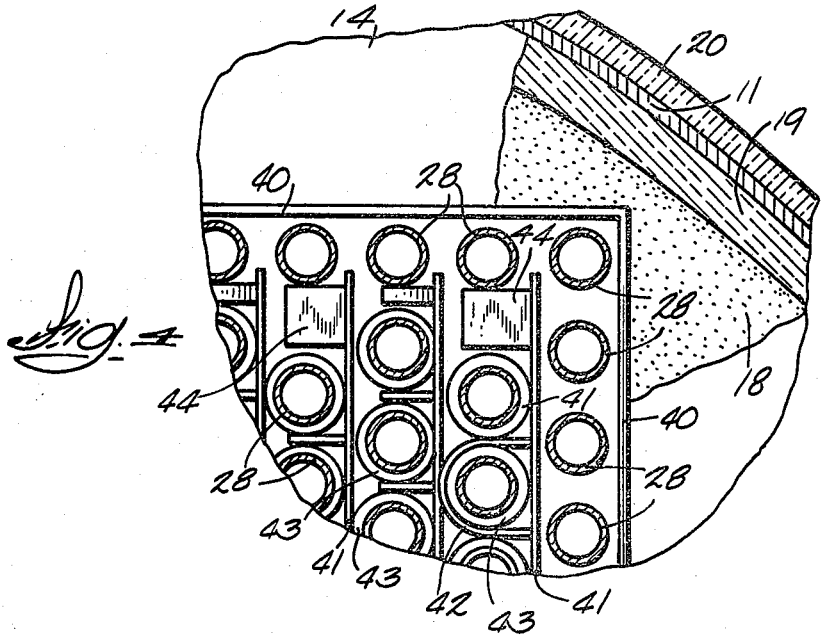
FIG. 4 is a partial transverse view, with portions broken away, of the boiler of FIGS. 1–3.

Referring now to FIG. 3, a circular baffle 14 extends across the interior of the shell and divides it into an upper compartment 15 and lower compartment 16. The baffle 14 comprises a metal dished element 17 that is lined along its upper surface with refractory material 18 so as to cool the metal element 17. The upper compartment 15 may be lined with refractory 19 to protect the shell 11 against high temperature gases. Also, the exterior of the upper compartment can be covered with blanket insulation 20.

A downcomer or water feed pipe 25 extends from an external steam drum 26 (FIG. 1) and into the lower compartment 16 of the boiler (FIGS. 2 and 3) for the supply of water to be heated by the boiler. Feedwater for the boiler enters the steam drum through supply pipe 31. The lower end of the downcomer pipe 25 communicates with a cylindrical lower header 27 that extends across the boiler. Water tubes 28 are connected at their lower ends to the lower header 27 and at their upper ends to an upper header 29 located in the upper compartment 15 of the boiler, the water tubes extending through a central opening in the baffle. The upper header is also a cylindrical vessel positioned across the boiler, but it may have its ends outside the shell as shown in FIG. 2. Steam outlet pipes 30 extend from each end of the upper header 29 to the external steam drum 26. Thus, water enters the boiler 10 through the downcomer pipe 25 and flows to the lower header 27 from whence it rises through the water tubes 28 to the upper header 29, during which circulation it is heated to generate steam that is collected in the upper header and withdrawn through the exit pipes 30 to the external steam drum 26.

As an important feature of the above structure, it will be noted that the lower header 27 is supported only by the lower ends of the water tubes 28. This provides a "floating" attachment of the lower header to thereby reduce the adverse effects of thermal stress. Also, the water tubes 28 are supported from the upper header.

Figure 1:
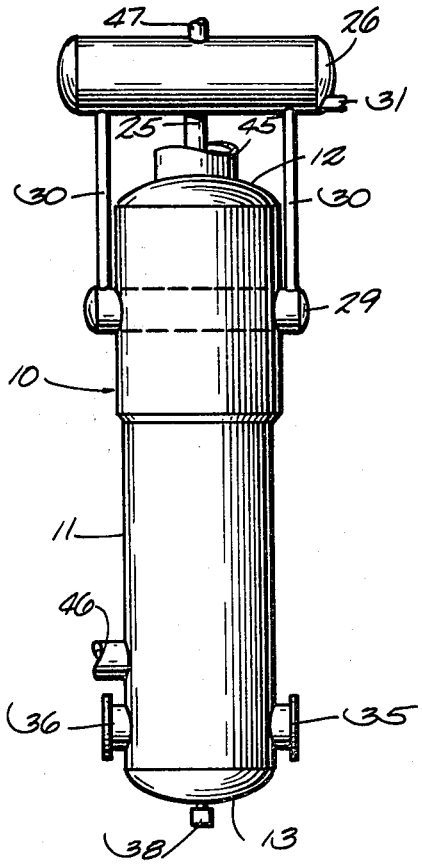
FIG. 1 is a side view of a heat recovery boiler constructed according to the present invention.
Figure 2:
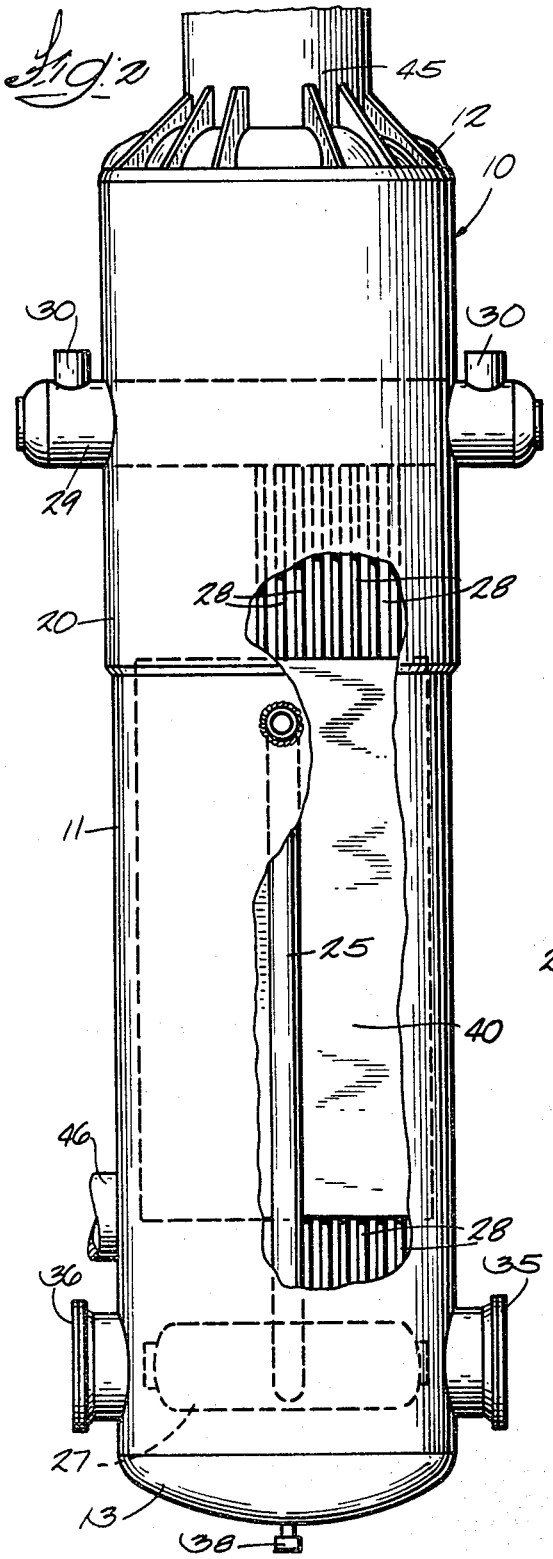
FIG. 2 is a detailed side view, with portions broken away, of the heat recovery boiler of FIG. 1.

Manways 35 and 36 may extend through the shell 11 adjacent each end of the lower header 27 as shown in FIGS. 1 and 2 to facilitate installation and service of the boiler. Blow-off pipe 37 extends from the lower header through lower head 13 as best illustrated in FIG. 3. A drain 38 is also provided at the lower end of the boiler.

As depicted in FIGS. 2 and 3, the water tubes 28 are arranged in a rectangular bundle and extend through a rectangular opening defined in the baffle 14. A rectangular duct 40 is attached to the baffle 14, as by welding and extends downwardly therefrom to enclose the bundle of water tubes 28 for the purpose to be explained below. Details of the structural arrangement of the water tube bundle and the baffle are further illustrated in FIG. 4. The water tubes 28 are secured to bars 41 by U-bolts 42 at staggered positions (although they may also be positioned in-line) along the bundle in order to hold the individual water tubes into a rectangular assembly of tubes and prevent vibration of the water tubes. Spacers 43 are positioned between a U-bolt and a water tube. Tube supports 44 are placed between the water tubes at appropriate longitudinal positions along the tube bundle. The spacing of the water tubes 28 is selected so that they are close enough for effective heat transfer, yet far enough apart to reduce accumulation of solids between the tubes.

Hot gas enters the boiler 10 through a gas inlet pipe 45 that extends through the upper head 12 to communicate with the interior of the boiler. The hot gas flows downwardly through the upper compartment 15 and then into the lower compartment 16 from whence it exits through gas outlet pipe 46 the communicates with the interior of the lower compartment.

(B) Operation

Hot gas entering the boiler through the gas inlet pipe 45 flows downwardly about the upper ends of the water tubes 28 positioned within the upper compartment and then is directed vertically downward by the baffle 14 and rectangular duct 40 so as to be confined to longitudinal flow about the water tubes 28 through the lower compartment 16. The rectangular duct 40 defines a shroud means for directing the gas flow downwardly and parallel with the water tubes 28. The boiler can be designed to have a relatively high gas velocity without the danger of erosion and the high velocity, parallel downflow of the hot gas produces a self-cleaning effect. Solid particles contained in the gas are carried downwardly by the flowing gas stream reinforced by gravity. The baffle 14 is most usefully formed as a dished element having a concave surface facing towards the upper compartment of the boiler to better direct solids in the gas stream between the water tubes and into the lower compartment. When the hot gas contains a relatively large amount of solid particulates, the lower head 13 may be constructed in the form of a hopper to collect the solid particles. Water entering the boiler through the downcomer pipe 25 and flowing upwardly through the water tubes 28 is converted to steam by the transfer of heat from the hot gases. Steam collected in the upper header 29 is supplied to the external steam drum 26, from which it is withdrawn through steam supply pipe 47 for further use.

Figure 5:
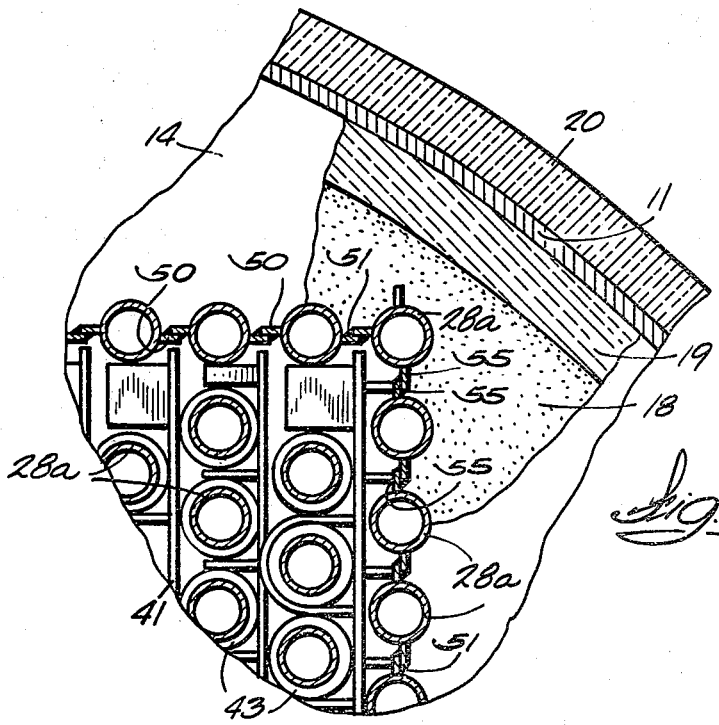
FIG. 5 is a view similar to FIG. 4 of an alternate embodiment of a portion of the boiler.

(C) Embodiment of FIG. 5

FIG. 5 illustrates an alternate construction for the bundle of water tubes in a manner to obtain the parallel downward flow of hot gas relative to the water tubes. In this version, the water tubes 28*a* disposed about the outer perimeter of the rectangular bundle are provided with diametrically opposed projecting longitudinal fins 50 that extend along the length of each tube 28*a*. A fin 50 of one tube slightly overlaps a fin 50 of an adjacent tube as illustrated in the drawing, and the overlapped tips of the fins are welded together in gas-tight fashion as indicated at 51. The fins 50, thusly joined together, form a rectangular vertical duct about the outside of the tubes for directing the hot gas flow parallel and downwardly of the tube bundle. The fins thus form a shroud means which performs the same function as the rectangular duct 40 shown in the embodiment of FIGS. 1–3. In a boiler incorporating the finned tube construction illustrated in FIG. 5, therefore, the rectangular duct 40 need not be inclined but the operation of the boiler will be the same as described above in connection with FIGS. 1–4.

The fins 50 also may be butted against one another, and welded together, instead of being overlapped as shown in FIG. 5.

Figure 6:
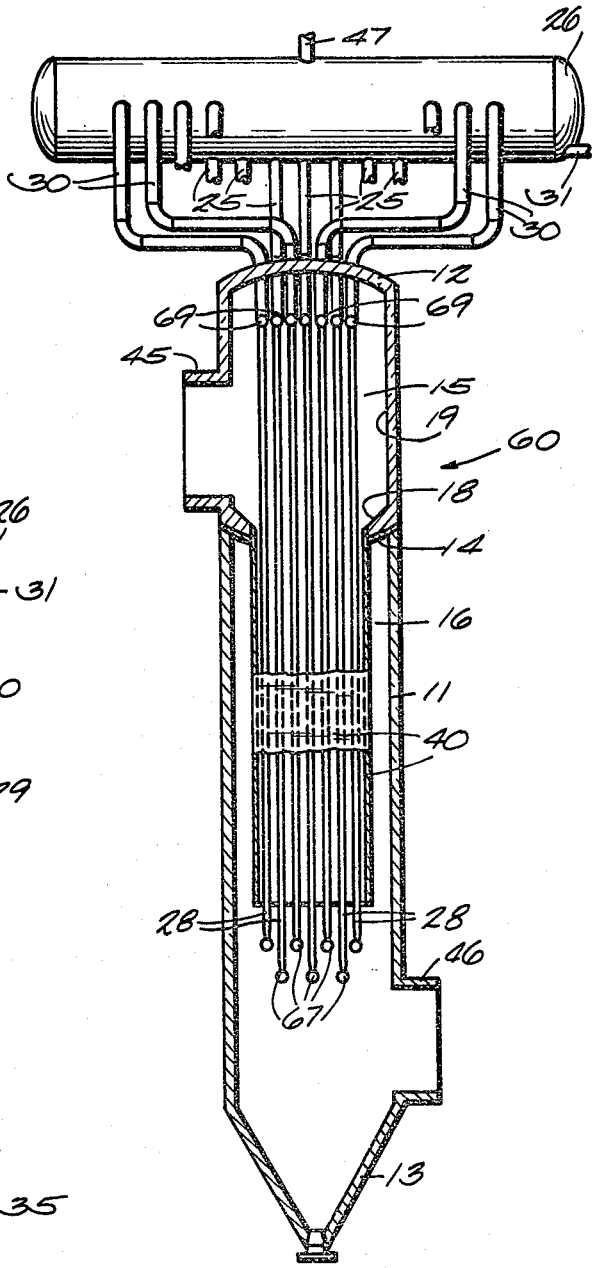
FIG. 6 is a side view, partly in section, of a second form of boiler of the present invention incorporating multiple headers.

(D) Embodiment of FIG. 6

The heat recovery boiler 60 illustrated in FIG. 6 includes many elements that are the same as the boiler 10 of FIGS. 1–4 and such elements are designated with the same reference numerals used in connection with the description of FIGS. 1–4.

The boiler 60 includes a closed pressure vessel formed by cylindrical shell 11 closed at its top end by upper head 12 and closed at its bottom end by lower head 13; the lower head 13 is in the form of a hopper-like element to facilitate the collection and ultimate removal of accumulated solids. Baffle 14 divides the interior of the shell 11 into upper compartment 15 and lower compartment 16, and gas inlet pipe 45 communicates with the upper compartment 15 through the side of the shell 11. Gas outlet pipe 46 communicates with the interior of the vessel through the side of the shell 11 near the lower end thereof.

Rectangular duct 40 depends from the baffle 14 and extends about the perimetry of a bundle of water tubes 28. The water tubes 28 are connected to and supported from a plurality of upper headers 69 located in the upper compartment 15. Each upper header 69 is connected to several water tubes which are behind the tubes 28 and therefore not visible in FIG. 6. A plurality of lower headers 67 are connected to and supported from lower ends of the water tubes 28, each lower header being connected to several water tubes not visible in FIG. 6. The lower headers are most usefully staggered as illustrated in the drawings so as not to restrict the solids and gas flow between the headers. Thus the boiler 60 incorporates multiple upper headers and multiple lower headers as compared to the single lower and upper headers of the boiler of FIGS. 1–4.

Each upper header 69 is connected to external steam drum 26 by a steam outlet pipe 30. Water is supplied to the boiler 60 by downcomer pipes 25 which extend from the external steam chest 26 to the lower headers 67, there being a downcomer pipe for each lower header.

The operation of the boiler 60 is the same as that of the boiler 10 previously described. Also, it may be noted that the finned tube construction described above with respect to FIG. 5 may be employed with the boiler 60 in lieu of the rectangular shroud 40. The boiler 60 is especially useful for recovering heat from high pressure gas streams because of its use of multiple upper and lower headers.

Industrial Applicability

There has thus been described a boiler especially suitable for the recovery of heat from high pressure gas streams in order to generate steam therefrom, which gas pressure may be as high as 300 to 900 psig. The boiler may be used with various processes having gas streams at these high pressures, such as recovering heat from coal gas in coal gasification processes and recovering heat from process streams in steam methane reforming processes. In addition, the new boiler may be used to recover heat from gas streams at pressures lower than this range, such as recovering heat from flue gas in fluid catalytic oil refining processes. Further, our new boiler is suitable for the generation of steam at various pressures, such as in the range of 150 to 2,000 psig.

Our new heat recovery boiler described above has a number of useful advantages. The use of vertical water tubes in a vertical pressure vessel facilitates the recovery of heat from a gas stream containing solid materials. This is further enhanced by the baffle dividing the boiler into upper and lower compartments together with shroud means surrounding the perimeter of the bundle of water tubes, such as the duct or finned tube constructions described above. These features provide a high velocity, parallel downflow of the gas which produces a self-cleaning effect. The water tubes are supported from the upper header or headers of the boiler, and the lower header or headers are supported from the lower ends of the water tubes, all of which minimizes the adverse effects of thermal stress so as to provide a boiler which can handle high temperature and high pressure gas streams. Moreover, the water tubes are of simple design, unlike prior art U-tubes or the double concentric tubes of the bayonet design, which allows the water tubes to be drained through the lower headers; this permits facile removal of any solids which may accumulate inside the water tubes.

We claim:

1. A boiler for generating steam by the recovery of heat from a hot gas stream comprising, in combination (1) a closed vertical pressure vessel;

(2) a baffle extending across the pressure vessel to divide its interior into an upper compartment and a lower compartment, the baffle having a central opening therein;

(3) an inlet for a hot gas stream communicating with the upper compartment and an outlet for the gas stream leading from the lower compartment;

(4) an upper header arranged in the upper compartment;

(5) a bundle of vertical water tubes supported from the upper header and extending through the opening in the baffle to have lower ends positioned in the lower compartment of the pressure vessel;

(6) a lower header supported from the lower ends of the water tubes;

(7) means for supplying water to the lower header and into the water tubes;

(8) shroud means surrounding the perimeter of the bundle of water tubes in the lower compartment extending from the baffle towards the lower ends of the water tubes and adapted to direct the flow of hot gas downwardly through the lower compartment and longitudinally along the water tubes; and wherein hot gas entering the upper compartment of the boiler is directed into the lower compartment by the baffle and directed downwardly parallel with the water tubes by the shroud means and steam generated by heat transfer from the hot gas to water flowing upwardly through the water tubes is withdrawn from the upper header.

2. A boiler according to claim 1, wherein:

the shroud means is a duct secured to the baffle and extending about the perimeter of the bundle of water tubes.

3. A boiler according to claim 1, wherein:

the water tubes disposed about the perimeter of the bundle of water tubes have longitudinal fins extending from each side thereof, and said longitudinal fins are joined together to form the shroud means surrounding the perimeter of the water tubes in the lower compartment.

4. A boiler according to claim 1, 2 or 3 further including:

a plurality of upper headers arranged in the upper compartment;

a plurality of lower headers supported from the lower ends of the water tubes; and means for supplying water to each lower header and into the water tubes.

* * * * *